United States Patent [19]

Wells

[11] 4,254,756

[45] Mar. 10, 1981

[54] FIREPLACE APPARATUS

[76] Inventor: William T. Wells, 3930 W. Ajo Way, Tucson, Ariz. 85725

[21] Appl. No.: 50,476

[22] Filed: Jun. 20, 1979

[51] Int. Cl.[3] ..... F24B 7/04; F24B 1/18

[52] U.S. Cl. ..... 126/121; 126/123

[58] Field of Search ..... 126/121, 123, 140, 202, 126/131; 160/DIG. 9; 49/366, 505; 52/217

[56] References Cited

U.S. PATENT DOCUMENTS

| | | | |
|---|---|---|---|
| 1,255,493 | 2/1918 | Williams | 126/123 |
| 3,913,558 | 10/1975 | Caldwell | 126/140 |
| 3,995,612 | 12/1976 | Deiu | 126/202 |
| 4,015,581 | 4/1977 | Martenson | 126/121 |
| 4,166,444 | 9/1979 | Martenson | 126/123 |
| 4,183,347 | 1/1980 | Newsmanger | 126/121 |

FOREIGN PATENT DOCUMENTS

| | | | |
|---|---|---|---|
| 1014810 | 8/1977 | Canada | 126/202 |

*Primary Examiner*—Herbert F. Ross

*Attorney, Agent, or Firm*—H. Gordon Shields

[57] ABSTRACT

Fireplace apparatus insertable into an existing fireplace, and compatible with an existing chimney structure includes a double wall on the sides and at the back of a firebox and two separate air systems are provided, one system for combustion air and a second system for heated air. The combustion air moves vertically through hollow grates on which fuel is disposed for burning, and vertically through the firebox and by heat exchanger tubes and into a chimney.

16 Claims, 10 Drawing Figures

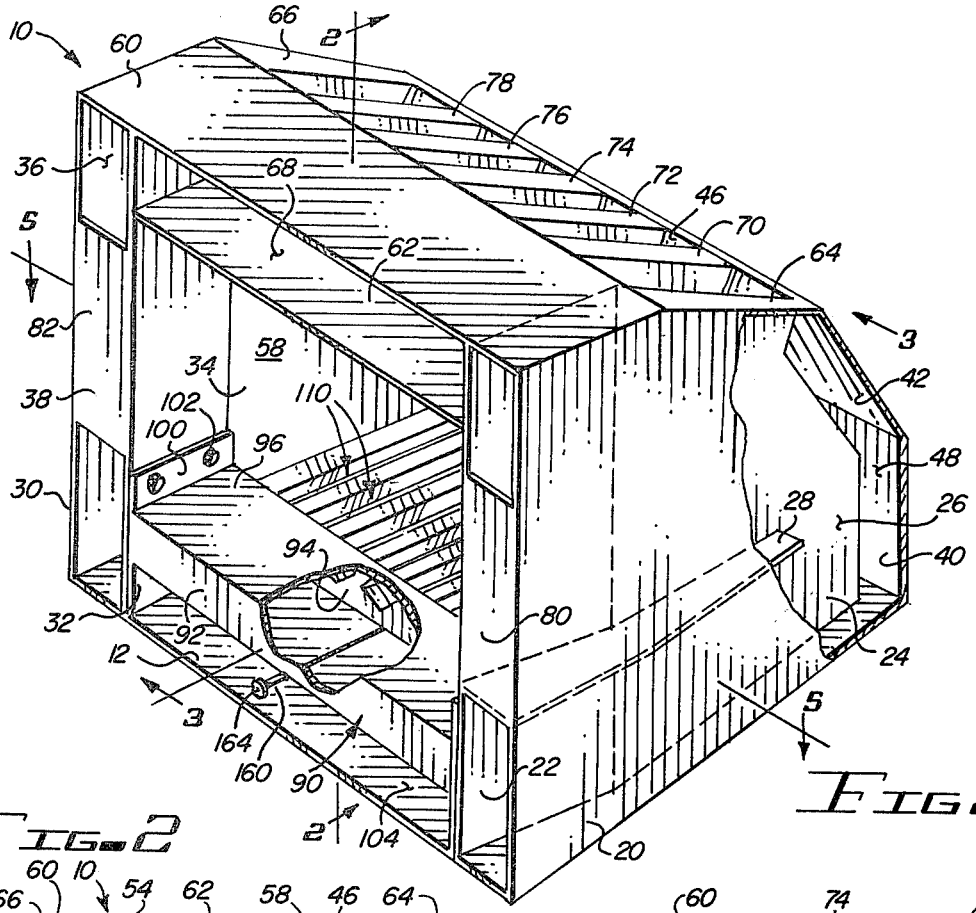
FIG. 1
FIG. 2
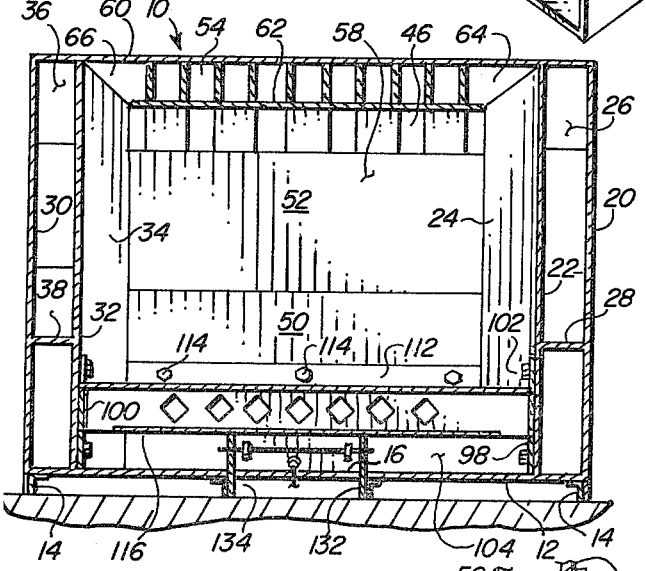
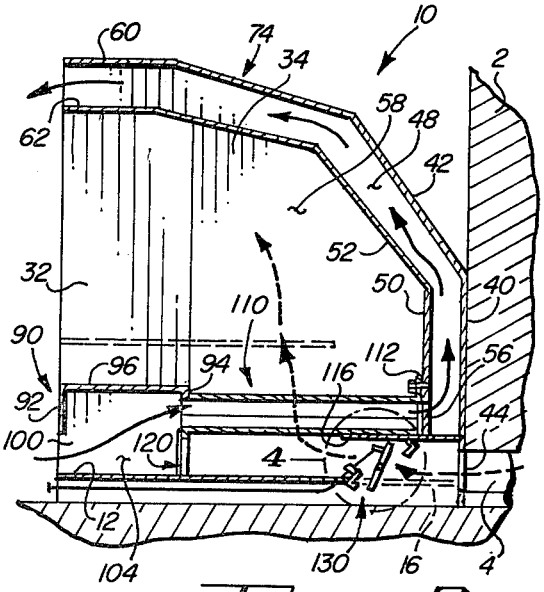
FIG. 3
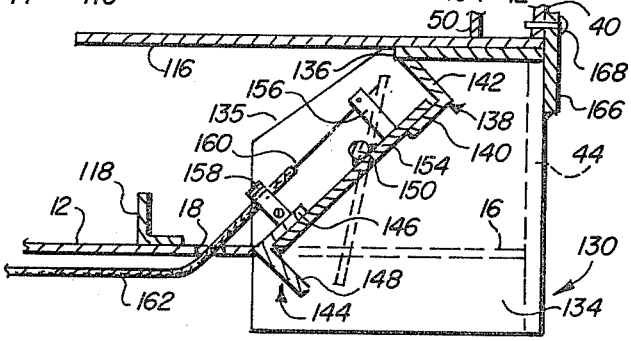
FIG. 4

FIREPLACE APPARATUS

BACKGROUND OF THE INVENTION

1. Field of the Invention

This invention relates to fireplaces, and more particularly, to a metal (steel) fireplace which is insertable into an existing masonry fireplace and compatible with the existing chimney or flue structure of the masonry fireplace and which substantially increases the efficiency of the utilization of heat produced by the fireplace.

2. Description of the Prior Art

As is well known and understod, fireplaces have existed in various forms for many years, even for perhaps thousands of years. As is also well known and understood, fireplaces are relatively inefficient in the utilization of heat produced by the burning or combustion of fuel in the fireplaces. Various suggestions have been made toward increasing the efficiency of fireplaces, such as the well known "heatolator" type fireplace, in which a metal (steel) fireplace is used with double walls on the sides of the firebox or combustion chamber, and, by convection, air is drawn in at the bottom of the sides, heated, and moves outwardly at the upper portion of the fireplace sides.

Even more recently, particularly associated with the energy conservation movement of recent years, attempts have been made to increase further the efficiency of fireplaces.

U.S. Pat. No. 462,197 illustrates the use of tubes or pipes which extend across, in a generally vertical manner, a fireplace combustion chamber for heating air flowing by convection in the pipes. The pipes communicate with a cold air chamber at their lower end, and with a hot air chamber at their upper end.

U.S. Pat. No. 929,436 discloses a heater in which pipes are used for heating water. A double walled structure is disposed about the combustion chamber for increasing the efficiency of the heat utilization.

U.S. Pat. No. 2,258,882 and U.S. Pat. No. 2,322,016 both disclose double wall apparatus in which convection currents are utilized to increase the efficiency of the heat produced from combustion by using a fireplace to heat auxiliary air moving around the fireplace apparatus.

U.S. Pat. No. 2,453,954 discloses a stove insertable in a fireplace. Hollow tubular grates are used. The hollow grates pick up air at the rear of the fireplace, and allow the heated air to flow outwardly through the front of the fireplace.

U.S. Pat. No. 2,470,430 discloses a fireplace in which outside air is brought into a fireplace by a system of ducts.

U.S. Pat. No. 2,789,554 also discloses the use of an auxiliary air flow to increase the efficiency of the fireplace, by inserting ductwork around the fireplace and above the fireplace in the chimney flue area.

U.S. Pat. No. 3,845,754 discloses separate air flow systems, one for combustion air and a second for heated air.

U.S. Pat. No. 3,926,175 discloses a metal fireplace which utilizes outside air for combustion air and also for heating. The incoming outside air mixes with air within the structure, and the two air systems are not separated for heating or combustion purposes.

U.S. Pat. No. 3,976,048 discloses fireplace apparatus which includes two separate air systems, one for combustion purposes, which is outside air, and a second for heating purposes. The combustion air is ducted to the front of the combustion chamber.

U.S. Pat. No. 4,026,263 discloses fireplace apparatus in which two air systems are utilized, outside air for combustion, and the outside air also mixes with the inside air for the circulation of heated air. Hollow grates are also used to increase the efficiency of the apparatus. The front of the combustion chamber of the fireplace is also sealed, as with the '048 apparatus.

U.S. Pat. No. 4,059,090 discloses apparatus which includes a housing surrounding a firebox and the housing is vented to outside air and also to the interior of the structure in which the apparatus is disposed. Exterior air is drawn into the housing, it is circulated about the firebox, and through conduits which extend through the chimney flue before exhausted into the room or structure through a front vent. A portion of the same flow of air is also passed through the bottom of the unit to provide air for combustion. Additionally, air from within the structure or house flows through the front doors of the apparatus to provide additional air for combustion purposes.

A plurality of conduits extend across the flue in the '090 patent for providing additional heating of the air passing through them. It will be noted that this feature, the provision of ducts extending through the flue, is also disclosed in the '236 patent and the '048 patent, discussed above, and in the '488 patent, discussed below.

U.S. Pat. No. 4,061,127 discloses a fireplace disposed in a mobile home, with the conbustion chamber sealed and outside air used for combustion purposes. Doors at the front of the fireplace are used to seal the combustion chamber from the interior of the mobile home.

One of the most efficient prior art fireplaces is disclosed in U.S. Pat. No. 4,135,488. Two separate air flow systems are used in the '488 apparatus. One air system is for combustion air, drawn from outside the home or structure in which the fireplace is disposed. A second air flow system uses inside air, circulated about the apparatus, and into the home or structure after being heated.

In addition to the above cited patents, there are hollow tubular grates which curve upwardly and forwardly. The lower portion of such structure comprises a relatively horizontally extending grate structure on which fuel is disposed for burning. Air is drawn into the lower portion of the grates and is heated as it flows through the grates. The heated air is then returned to the room.

One of the problems of such apparatus is burning. The heat radiates outwardly and downwardly from the lower portion of the hollow grates and reflects back, burning the grates. The burnout of such apparatus accordingly results in a relatively short period of time.

SUMMARY OF THE INVENTION

The invention described and claimed herein comprises a metal fireplace insertable into an existing masonry fireplace and which includes double walls disposed about a combustion chamber and two separate air systems, one providing outside air for combustion purposes, and one providing interior air for heating purposes and for cooling hollow grates on which fuel is placed.

Among the objects of the present invention are the following:

To provide new and useful fireplace apparatus;

To provide new and useful fireplace apparatus insertable into a preexisting masonry fireplace;

To provide new and useful apparatus for controlling the rate of combustion in a fireplace to extend the burning of fuel for a longer time period than without controlling the rate of combustion in order to conserve fuel;

To provide new and useful fireplace apparatus in which heated air is distributed by gravity and natural convection without mechanical interruption of the volume of air of the structure in which the fireplace apparatus is located;

To provide fireplace apparatus having two separate air systems including a heated air system and a combustion air system using outside air for combustion;

To provide new and useful fireplace apparatus using hollow grates to transfer room air from the front of the fireplace apparatus to the rear of the fireplace for heating purposes;

To provide new and useful fireplace apparatus having a heated air chamber disposed about a combustion chamber; and To provide new and useful fireplace apparatus having an air valve for controlling the flow of air of one air system for combustion purposes without affecting a second flow of air for heating purposes.

BRIEF DESCRIPTION OF THE DRAWING

FIG. 1 is a perspective view of the apparatus of the present invention.

FIG. 2 is a view in partial section of a portion of the apparatus of FIG. 1, taken generally along line 2—2 of FIG. 1.

FIG. 3 is a view in partial section of a portion of the apparatus of FIG. 2 taken generally along line 3—3 of FIG. 1.

FIG. 4 is an enlarged view in partial section of a portion of the apparatus of FIG. 3, taken generally from circle 4 of FIG. 3.

DESCRIPTION OF THE PREFERRED EMBODIMENT

FIG. 1 comprises a perspective view of fireplace apparatus 10, which apparatus is insertable into an existing masonry fireplace to provide a substantially increased efficiency in the consumption or burning of fuel over the preexisting masonry fireplace. The fireplace apparatus 10 is made or fabricated from sheet steel and includes a double enclosure, including inner and outer walls, which are shown in more detail in FIGS. 2, 3, 5, and 6.

For a general discussion of the fireplace apparatus 10, in general, reference will be made primarily to FIGS. 1, 2, 3, 5, and 6.

Air from outside the structure (home) in which the apparatus 10 is used is brought into the fireplace apparatus 10 through an air valve 130, and details of the air valve are shown in FIGS. 3 and 4. FIG. 4 comprises an enlarged view in partial section of the air valve apparatus 130, taken generally from circle 4 of FIG. 3. For the description of the air valve, reference will be made hereinafter primarily to FIGS. 3 and 4, although the air valve 130 is also shown in FIG. 2.

Figure 5:
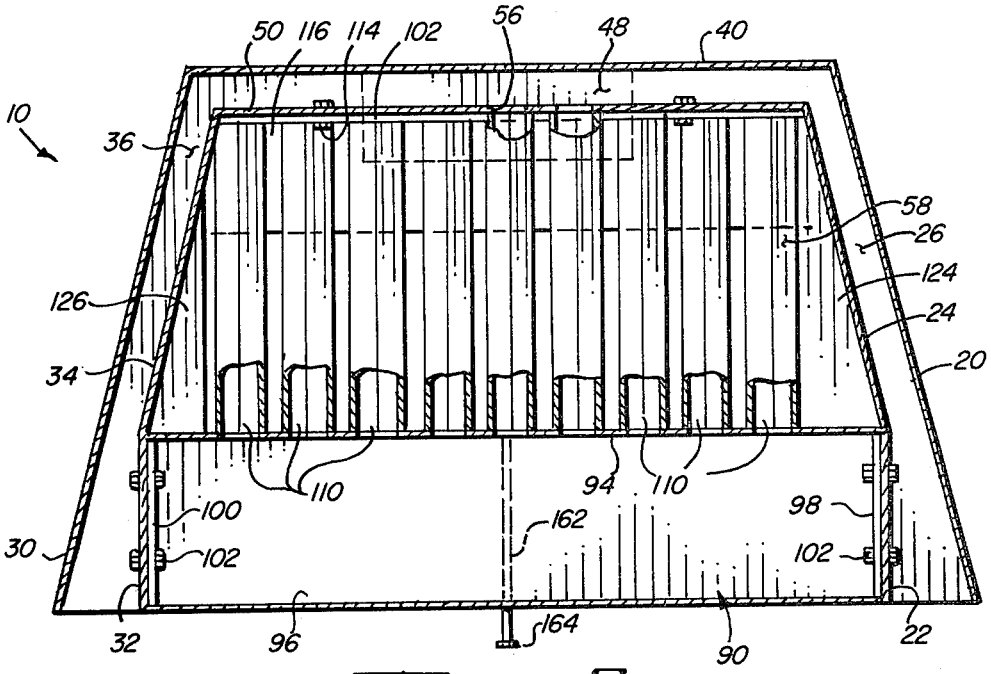
FIG. 5 is a view in partial section of a portion of the apparatus of FIG. 1 taken generally along line 5—5 of FIG. 1.
Figure 6:
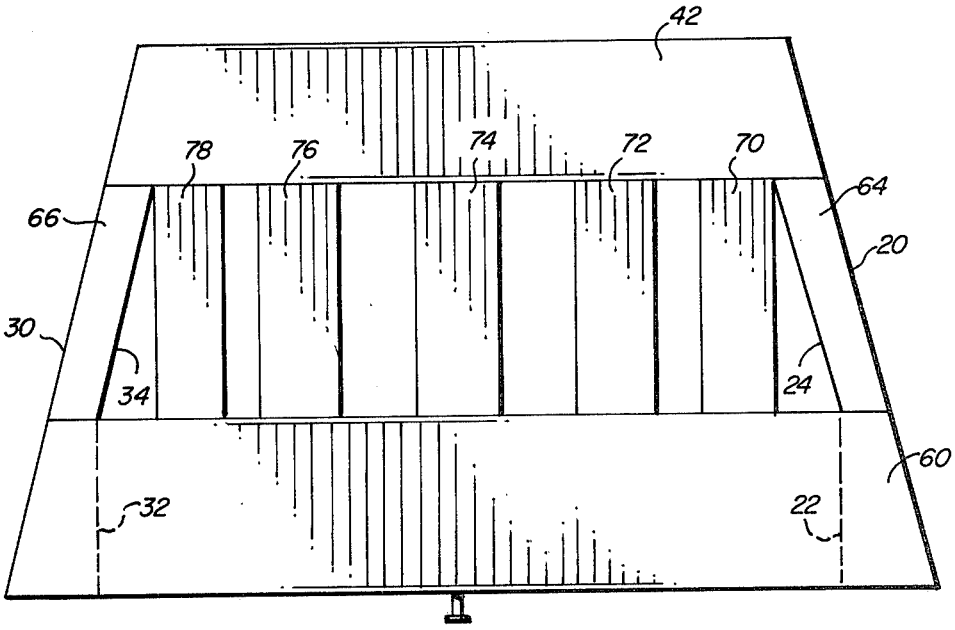
FIG. 6 is a top view of the apparatus of the present invention.

The fireplace apparatus 10 includes a right side outer wall panel 20, and a left side outer wall panel 30. The wall panels 20 and 30, as best shown in FIG. 5 and FIG. 6, extend rearwardly at an acute angle with respect to the front of the fireplace apparatus 10. Accordingly, the wall panels or plates 20 and 30 are not parallel to each other.

Spaced inwardly from the right and left side outer wall panels are a pair of right and left side inner wall plates or panels. Each inner side wall is comprised of a pair of front and rear wall panels, including a right side inner wall front panel 22 and a right side inner wall rear panel 24, a left side inner wall front panel 32, and a left side inner wall rear panel 34. The front panels 22 and 32 are spaced apart and are substantially parallel to each other. From the rear portion of the front panels 22 and 32, the rear panels, including the rear panel 24 and the rear panel 34, extend rearwardly substantially parallel to the outer wall panels 20 and 30, respectively. This feature is best shown in FIG. 5. Obviously the inner wall panels are made of a single sheet or plate, with a portion bent as desired on a metal brake or the like.

A base plate 12 extends between the outer walls 20 and 30, to which it is appropriately secured, as by welding. As best shown in FIG. 2, the inner walls, including the panels 22 and 24, and 32 and 34, are secured to the top of the base plate 12, but they do not extend below the base plate, as do the outer walls 20 and 30. As also best shown in FIG. 2, four angle iron stiffeners 14 are shown secured to the base plate 12. Two of the stiffeners 14 are shown secured to the base plate and to the outer walls 20 and 30, and two other stiffeners 14 are shown spaced apart between the outer walls and extending downwardly from the base plate 12. The stiffeners may simply be lengths of angle iron appropriately secured, as by welding the base plate 12 and also to the outer wall panels 20 and 30.

At the rear of the apparatus 10 is an outer back wall lower panel 40 and an outer back wall upper panel 42, which may be fabricated from a single plate or sheet of steel and appropriately bent, as desired. The lower panel 40 extends between the outer side panels 20 and 30 and upwardly from the base plate 12. The lower panel 40, as best shown in FIG. 3, extends upwardly substantially perpendicular to the base plate 12. The outer back wall upper panel 42 extends upwardly from the upper portion of the lower panel 40 and forwardly, as best shown in FIGS. 1 and 3. Both panels 40 and 42 extend between the outer panels 20 and 30.

Spaced apart from the outer back wall panels 40 and 42 are a pair of inner back wall panels, including an inner back wall lower panel 50 and an inner back wall upper panel 52. The inner back wall lower panel 50 is substantially parallel to the outer back wall lower panel 40, and spaced apart therefrom. The upper panel 52 is secured to the lower panel 50, and extends forwardly spaced apart from, and nearly parallel to, the outer upper back wall panel 42. The panels 50 and 52 are secured to the inner wall rear panels 24 and 34. This may be seen from FIGS. 2 and 3.

An upper plate or panel 46 extends between the top or upper portions of the plates 42 and 52, and between the inner side wall rear panels 24 and 34. The panel 46 is shown best in FIGS. 1 and 2.

The base plate 12 includes a cut out portion 16 which is of a generally rectangular configuration for receiving an air valve assembly 130. The cut out 16 is shown in FIG. 2, and is also shown in FIGS. 3 and 4. The outer back wall lower panel 40 also includes a cut out 44 for receiving the air valve 130.

At the top of the apparatus is an outer top wall 60, shown in FIGS. 1, 2, and 3, which extends between the outer side walls 20 and 30. Spaced apart downwardly from the top wall panel 60 is an inner top wall panel 62. The wall panel 62 extends between the inner front wall panels 22 and 32, and substantially parallel to the panel 60.

Another pair of top panels, including a right side top panel 64 and a left side top panel 66, extend extends between the top panel 60 and the upper portion of the outer back wall upper panel 42, and between the outer and inner side panels. Panel 64 extends between side panels 22 and 24, and the panel 66 extends between outer and inner panels 30 and 34. The panels 64 and 66 are best shown in FIGS. 1 and 2.

With the various outer and inner panels in position, as described above, it will be noted that there are several chambers defined between the various panels. A right side heated air chamber 26 is defined between the outer panel 20 and the inner panels 22 and 26, above the base plate 12, and beneath the panels 60 and 64, and forwardly of the back wall panels 40 and 42. A similar heated air chamber 36 is defined between the left side panels 30 and 32, above the base plate 12, beneath the top panels 60 and 66, and forwardly of the back panels 40 and 42. The two heated air side chambers 26 and 36 communicate directly with a rear heated air chamber 48. The heated air chamber 48 is shown best in FIGS. 1 and 3. It extends above the base plate 12, and between the outer and inner rear or back wall panels 40, 42, and 50, 52, and downwardly from the upper plate or panel 46.

A fourth heated air chamber 68 extends between the inner side panels 22 and 32, below the top wall 60, above the inner top wall 62, and forwardly of an upper rear front panel 54. The upper rear front panel 54 is best shown in FIG. 2.

Communication between the heated air chambers 48 and 68 is provided by a plurality of ducts 70, 72, 74, 76, and 78. The ducts 70 . . . 78 comprise square tubing which extend between, and are appropriately secured to, the panels or plates 46 and 54. The panels or plates 46 and 54 include apertures to receive the ducts 70 . . . 78. The ducts are preferably welded to the plates 46 and 54. Thus, the heated air flow from the heated air chamber 48 is upwardly in the chamber 48, through the ducts 70 . . . 78, and into the chamber 68. From the chamber 68, the air flows outwardly into the room in which the fireplace apparatus 10 is located.

Within the right side heated air chamber 26 is a generally horizontally extending baffle or panel 28. The panel 28, as shown in FIGS. 1 and 2, extends from the front of the apparatus and between the right side outer wall panel 20 and the right side inner wall panels 22 and 24. The plate or baffle extends rearwardly about two-thirds of the distance from the front of the apparatus towards the rear of the apparatus. The plate or panel 28 acts as a baffle to divide the chamber 26 into an upper portion and a lower portion.

The plate or panel 38 acts as a similar baffle in chamber 36. It is disposed between the outer wall 30 and the inner side walls 32 and 34 to divide the heated air chamber 36 into an upper and a lower portion, above and below the plate or panel 38, respectively, Above the plate 28, and extending between the panels 20 and 22, is a plate 80. The plate 80 is disposed at the front of the fireplace apparatus 10, and it comprises, with the plate or panel 28, an L shaped baffle at the front of the upper forward portion of the heated air chamber 26. A plate 82 extends upwardly from the front portion of the plate 38 and between the panels 30 and 32 to also comprise a baffle at the upper front portion of the heated air chamber 36.

Room air is drawn by naturally occurring convection currents into the fireplace apparatus 10 beneath the baffle plate 28 and the baffle plate 38 and into the heated air chambers 26 and 36, respectively. The room air flows rearwardly where heat is transferred to the air from the inner side wall panels 20, 24, and 32, 34, respectively. The heated air then begins to rise in the chambers 26 and 36. Some of the air may flow rearwardly into the rear heated air chamber 48. Most of the air flows upwardly and forwardly in the heated air chambers 26 and 36, respectively. The upwardly and forwardly flowing heated air returns to the room from above the panels 80 and 82, respectively, from the chambers 26 and 36. At the same time, heated air flows upwardly within the rear heated air chamber 48, and upwardly and forwardly through the ducts 70 . . . 78 into the chamber 68. The heated air then flows into the room from the chamber 68. The air in the chamber 48 is supplied primarily through a plurality of hollow grates 110, supplied from a manifold 90, as discussed below.

At the front of the apparatus 10, spaced above or separated from the base plate 12, is the manifold 90. The manifold 90 is open on the bottom, and accordingly comprises three primary plates or panels, including a front vertically extending panel 92, a rear vertically extending panel 94, and a top panel 96. The front and rear panels are spaced apart from each other and are substantially parallel to each other. The top panel 94 is secured to both the front panel 92 and the rear panel 94.

The panels 92, 94, and 96 are in turn secured to a pair of end plates 98 and 100. The end plates are preferably welded to the three manifold plates. The three panels of the manifold 90 are welded to the upper portions of the end plates 98 and 100. The end plates are appropriately secured, as by a plurality of bolts 102, to the right and left side inner wall front panels 22 and 32, respectively. The end panels 98 and 100 rest on the base plate 12, and extend upwardly therefrom, thus defining a passageway 104 between the open bottom of the manifold and the base plate 12.

Secured to the rear panel 94 of the manifold 90 are the plurality of grates 110. The grates 110 are each preferably comprised of square tubing welded at one end to the plate 94 and at an opposite end to another plate 112. The plates 94 and 112 include appropriate apertures for receiving the ends of the square tubing grates 110. The grates, as best shown in FIGS. 1 and 2, are oriented with their edges extending vertically and horizontally, as opposed to the four walls or sides of the grates being oriented vertically and horizontally. The walls or sides of the grates are thus disposed at an angle to the horizontal and to the vertical of about 45°. The top edges of the grates define a surface on which fuel is disposed for burning. The square tubing grates are spaced apart to allow air to flow vertically upwardly through the grates and to allow ashes to fall vertically downwardly between the grates. As ashes or residue of the combusting fuel fall, they fall between the spaced apart grates downwardly to an ash tray 120.

The square configuration of the hollow grates provides maximum surface area for heat transfer purposes. At the same time, the angle of the sides of the grates allows the ashes and any residual material to fall off the grates into the ash tray 120.

The plate 112 is shown in FIGS. 2 and 3 as secured to the inner rear wall 50 by a plurality of fasteners, such as bolts 114. The ash tray 120 is shown outlined in phantom in FIG. 3. It extends rearwardly from beneath the plate or panel 94 of the manifold 90 and beneath the grates 110.

The rear portion of the grates 110 are disposed on top of an ash blockage plate 116 which extends horizontally forwardly from the rear walls 40 and 50, and between the right and left side inner rear panels 24 and 34, as best shown in FIG. 5. The ash blockage plate 116, as best shown in FIGS. 3, 4, and 5, extends forwardly from the inner rear wall panel 50 a relatively short distance. This allows maximum area for the ashes and other residue of combustion to fall beneath the grates 110 into the ash tray 120.

As best shown in FIG. 4, a small angle iron bracket 118 is secured to the base plate 12 just rearwardly of the front edge of the ash blockage plate 116. The angle bracket 118 comprises a stop to limit the rearward movement of the ash tray 120.

Air from the room in which the fireplace apparatus 10 is disposed flows through the passageway 104, upwardly into the manifold 90, and rearwardly through the grates 10. From the grates 110, the air flows through a plurality of apertures in the rear plate 112, secured to the grates, and through a plurality of appropriate apertures 56 in the inner back wall lower panel 50. The apertures or holes 56 are appropriately aligned with the apertures in the plate 112, and the air thus flows into the rear heated air chamber 48. If desired, the apertures 56 in the rear panel 50 may simply be relieved or cut away portions in the panel 50 which are covered by the plate 112 to allow for the unrestricted flow of the air from the grates 110 into the chamber 48. The ash tray 120 serves to block the flow of air beneath the grates 110 from the passageway 104. The ash tray accordingly extends vertically between the base plate 12 and the manifold rear panel 94, as shown in FIG. 3, and laterally between the inner side wall panels 24 and 34. The configuration of the ash cart is trapezoidal to accommodate the inward slope of the panels 24 and 34, as best shown in FIGS. 2 and 5. The ash tray includes a front panel which extends upwardly above the bottom edges of the panel 94 to provide an effective seal between the room air flowing from the passageway 104, into the manifold 90, and into the grates 110, and the combustion air flowing through the air valve 130 and vertically between the grates 110. Since the front panel or lip of the ash tray 120 seals against the lower or bottom portion of panel 94, it is obvious that the front panel 92 does not extend downwardly as far as the real panel 94 does, thus allowing the ash tray to be removed easily. In FIG. 5, the ash blockage plate 116 is shown as extending forwardly from the inner rear wall 50 between the side walls 24 and 34.

A pair of triangularly shaped filler plates 124 and 126 are shown extending between the inner side wall panels 24 and 34, respectively, towards the outer walls of the grates 110 and forwardly to the panel 94 of the manifold 90. The plates 124 and 126 are simply a pair of plates used to fill the space between the grates, the inner side walls, and the manifold. They deflect the ashes away from the walls 24 and 34, and into the ash tray. They also serve to help block the flow of combustion air upwardly except through the spaces between the grates 110 from the manifold 90 to the ash blockage plate 116.

Above the grates within the inner walls is a combustion chamber 58. The combustion chamber extends upwardly to the square tubes 70 . . . 78. A chimney, not shown, which may be the chimney or the fireplace in which the apparatus 10 is disposed, receives the combustion gases from the firebox or combustion chamber 58.

Combustion air for the heater apparatus 10 flows inwardly from the exterior of the building (house) in which the fireplace apparatus 10 is disposed through a cut out 44 in the lower panel 40, as best shown in FIG. 3. In FIG. 3, a passageway 4 is shown extending through a rear wall 2 of the house in which the apparatus 10 is disposed. Combustion air, shown as dashed lines, flows through the passageway 4 to the apparatus 10. The inwardly flowing air then passes through the air valve 130 and rises vertically through the space between the grates 110 to provide relatively complete combustion for the fuel (shown in phantom in FIG. 3). The air passes vertically by and around the fuel, rather than on top of the fuel, as in most prior art systems. Of the air passing on top of the fuel, a relatively small amount of air actually flows over the fuel to provide combustion oxygen. Hence, prior art systems result in a substantial amount of soot resulting from incomplete combustion. However, the air flow in the apparatus 10 is directly vertically past the fuel, and then vertically upwardly through the combustion chamber 58 and into the chimney (not shown).

The air valve 130 is best shown in FIGS. 2, 3, and 4. FIG. 4 comprises an enlarged side view of the air valve 130, and reference for the following description will be made primarily to FIG. 4, but also to FIGS. 2 and 3.

The air valve assembly 130 includes a pair of end plates 132 and 134 which are spaced apart from each other in substantially a parallel relationship. The end plates 132 and 134 are secured to a top plate 136, which extends rearwardly from a pair of diagonal edges of the end plate. A diagonal edge 135 for the end plate 134 is shown in FIG. 4. The diagonal edge 135, for all practical purposes, serves to bisect the top, horizontally extending edge or side of the plate 134 and the front vertically extending edge. The diagonal for the end plate 132 (not shown) is substantially the same as the diagonal 135.

Three elements are secured to, and extend between the end plates 132 and 134. The three elements are an angle iron bracket 138, a second angle iron bracket 144, and a pivot rod 150. The angle iron brackets 138 and 144 each include a pair of arms, as is typical of the construction of angle irons. The angle iron bracket 138 includes arms 140 and 142, and the angle iron bracket 144 includes arms 146 and 148. The arms 142 and 148 are generally parallel with each other and the arms 140 and 146 are also generally parallel with each other, and in a slightly offset alignment as clearly shown in FIG. 4. The arms 140 and 144 comprise a pair of stop plates which limit the pivoting motion of a valve plate 154. The plate 154 is welded to a pair of hinge rods, of which one hinge rod 150 is shown in FIG. 4. The hinge rod 150 in turn extends through an aperture in the end plate 134, and another hinge rod (not shown) also welded to the plate 154 and in alignment with the rod 150, extends through an aligned aperture in the end plate 132. The plate 154, welded to the hinge rods, pivots on the hinge rods and accordingly moves relative to the end plates 132 and 134 and also relative to the angle iron brackets 138 and 144. The plate 144 is shown in its closed position in FIG. 4, in which a portion of the plate 154 is disposed against the arm 140, and another portion of the plate, the lower portion, is disposed against the arm 146 of the bracket 144. The valve plate 144 is shown partially opened in phantom in FIG. 4. FIG. 3 shows the valve plate 144 open to illustrate the flow of combustion air.

If desired, the rod 150 may be a single rod extending the full width of the plate 154 and through the aligned apertures in the end plates.

An attachment bracket 156 is secured to the plate 154 above the pivot point at the rod 150. The bracket 156 extends substantially perpendicular from the plate 154. The bracket 156 is in general alignment with a second bracket 158, which is secured to the arm 146 of the angle iron bracket 144.

A cable 160 is secured to the bracket 156 and extends through a cable housing 162 which is in turn secured to the bracket 158. The cable housing 162, with the cable 160 therein, extends to a small aperture or hole 18 in the base plate 12 between the air valve 130 and the angle iron stop plate 118. The cable housing 162 with the cable 160 therein then extends forwardly, beneath the base plate 112, and beneath the manifold 90 to the front part of the fireplace apparatus 10.

The cable housing 162 is appropriately secured to the furnace apparatus 10, and a cable 160 terminates in a handle 164 which extends outwardly or forwardly with respect to the fireplace apparatus 10. Outward (forward) movement of the handle 164 causes the air valve plate 154 to pivot on its rod 150 and thus allows air to flow through the air valve assembly 130 and into the space between the base plate 12 and the grates 110. The air thus flowing through the air valve 130 comprises combustion air used for the combustion of fuel disposed on the grates 110.

It will be noted, particularly with reference to FIG. 3, that the air flowing through the air valve 130 performs a dual function of first, providing combustion air for burning, and second, providing cooling air underneath and between the grates, as the air flows vertically, to help prevent burn out of the grates during the combustion. Moreover, the air from the room in which the fireplace apparatus is disposed, flowing through the passageway 104 (see FIGS. 1, 2, and 3), and shown as a solid line in FIG. 3, flows through the manifold 90, through the grates 110, and into the heated air chamber 48. This air flow through the grates also brings relatively cool air flowing substantially constantly through the grates to also provide cooling air to help prevent the grates from burning. A constant heat transfer is thus accomplished for both the combustion air and the heated air.

Movement of the plate 154 in response to movement of the handle 164 and the cable 160 results in the control of the air flow through the air valve 130. The air valve 130 is shown with the plate 154 in closed position in FIG. 4, which substantially eliminates air for combustion and thus combustion decreases substantially. With the opening of the air valve, resulting from a pivoting of the plate 154, such as to the position shown in phantom in FIG. 4, (and see also FIG. 3) the air flow, which is preferably from the exterior of the building or home in which the fireplace apparatus is disposed, is forwardly and vertically through the grates 110 and vertically past the fuel on the grates.

Control of combustion is achieved within firebox or combustion chamber 58 by controlling the flow of combustion air through the air valve 130. Since the fireplace apparatus is sealed from the room, as discussed below, the only combustion air providing oxygen for combustion is through the air valve 130.

The air valve 130 is secured to the rear lower outer wall 40 by a plurality of fasteners, such as screws and/or bolts 168, shown best in FIG. 4. The bolts or screws 168 extend through appropriate holes or apertures in an attachment tab or plate 166, shown best in FIG. 4, secured, as by welding, to the upper portion of the side plates 134 and 134. The lower rear outer plate or panel 40 includes matching or mating holes or apertures which receive the fasteners.

The heat produced from combustion on the grates 110 is used to heat the air flowing through the passageway 104, the grates 110, and into the heated air chamber 48, and is also used to heat the room air flowing into the heated air chambers 26 and 36. The air flowing through the chambers 26 and 36 is heated by heat exchange between the air and the inner side walls, which comprise the side walls of the combustion chamber 58 and flows in the space between the ducts 70 . . . 78. The air flowing through the upwardly and forwardly extending ducts 70 . . . 78 is heated by heat exchange between the metal walls or panels of the ducts and the passage of the heated air on the inside of the ducts and the combustion gases, etc. flowing on the outside of the ducts.

Figure 7:
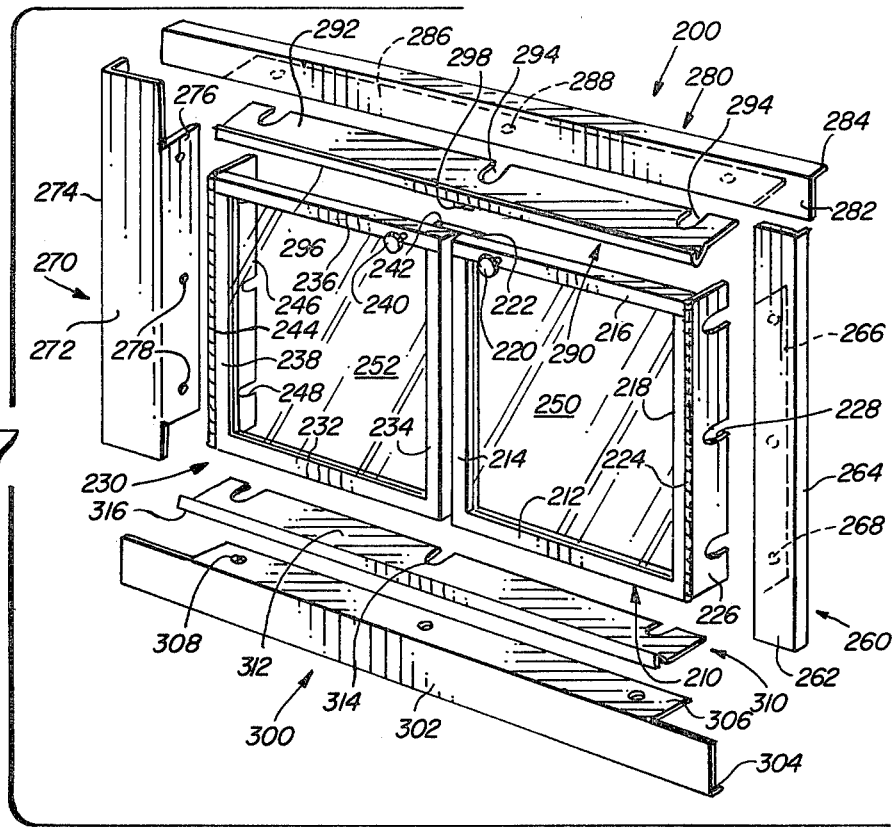
FIG. 7 is an exploded perspective view of the glass door apparatus used with the fireplace apparatus of the present invention.
Figure 9:
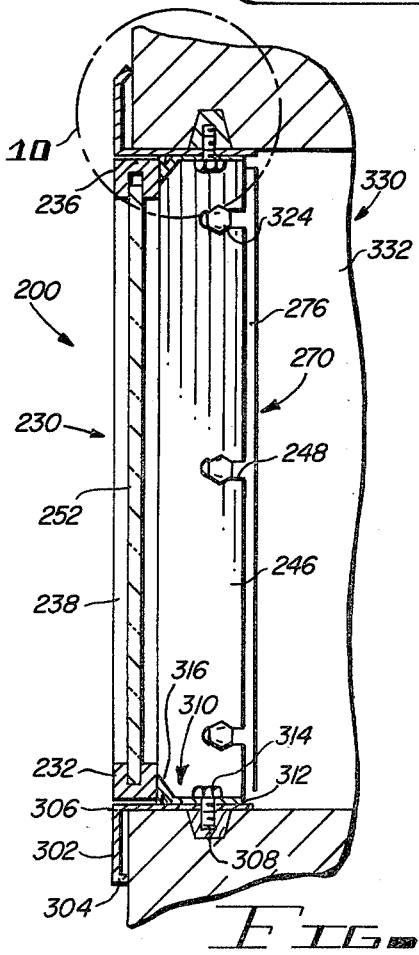
FIG. 9 is a view in partial section showing the securing of the door apparatus of FIG. 7 to a masonry fireplace.
Figure 10:
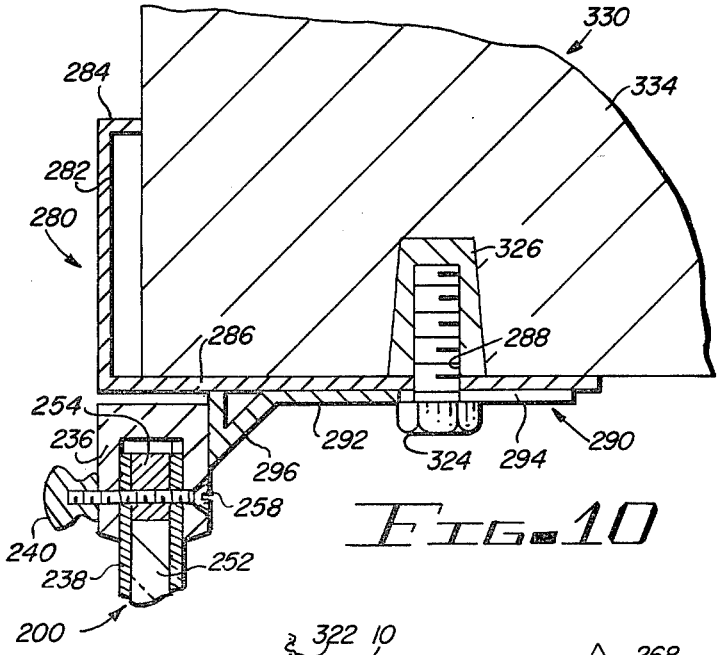
FIG. 10 is an enlarged view in partial section taken generally from circle 10 of FIG. 9.
Figure 8:
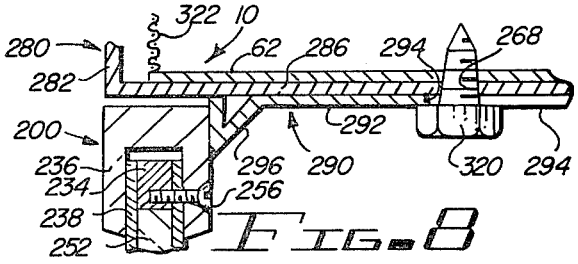
FIG. 8 is an enlarged view in partial section illustrating the securing of the door apparatus to the fireplace of FIGS. 1-6.

For sealing the combustion chamber 58 from the front, door apparatus 200 as shown in FIGS. 7, 8, 9, and 10, is used. FIG. 7 comprises a perspective view of the door apparatus 200, with the various elements of the door apparatus shown exploded from each other. FIG. 8 is an enlarged view in partial section of a portion of the door apparatus 200 of FIG. 7. FIG. 9 is a view in partial section of the door apparatus 200 of FIG. 7, and FIG. 10 is an enlarged view of the door apparatus 200 of FIG. 9, taken generally from circle 10 of FIG. 9. For the following discussion of the door apparatus 200, reference will be made to FIGS. 7, 8, 9, and 10.

The door apparatus 200 includes several different elements, shown exploded away from each other in FIG. 7. There are two door frames 210 and 230, each of which includes four generally U shaped frame members which receive glass panels 250 and 252, respectively. The frame members, illustrated herein as being generally U shaped, may be of any other appropriate configuration, as desired.

The door frame 210 includes four frame members, 212, 214, 216, and 218. Frame members 212 and 216 are respectively the bottom and top frame members, and frame members 214 and 218 are the side frame members. The top and bottom frame members are parallel to each other, as are the side members. The top or upper frame member 216 includes a pull or knob 220 secured to it adjacent the side frame member 218. The knob 220 is used to open the door, as desired, for adding fuel to the fireplace apparatus, etc.

On the rear of the frame member 216 is a catch or latch 222 which cooperates with another catch or latch 298 on an upper door jamb 290, as will be described in detail below.

The side frame member 218 has secured to it a piano hinge 224, which extends substantially the full length of the frame member 218. The piano hinge 224 includes a side panel 226, which is actually one leg of the hinge, with the other leg secured to the frame member 218. The side panel 226 has a number (three as shown) of slots 228 extending inwardly from the outer edge of the panel 226, remote from the hinge 224. The slots 228 cooperate with mating apertures in a door facing 260, described below, for securing the door frame 210 to the side of the furnace apparatus 200, or to the front of a masonry fireplace in which the fireplace apparatus 10 is inserted. If the fireplace in which the apparatus 10 is inserted is a metal fireplace, rather than a masonry fireplace, the door apparatus 200 may be bolted or screwed directly to the metal rather than into masonry, as discussed below.

The second door frame 230 is substantially identical to the door frame 210. It includes a bottom frame member 232, a side frame member 234, an upper or top frame member 236, and another side frame member 238. The frame members 232 . . . 238 are appropriately secured together, for holding a glass panel or pane. The frame members 232 . . . 238 may, as discussed above with respect to the door frame 210, be fabricated of U shaped channel or other appropriately configured material for holding a plate of glass.

The upper door frame member 236 includes the knob or pull 240, disposed adjacent the side frame member 234. As best shown in FIGS. 8 and 10, the top frame member 236 is a generally inverted U shaped member, the width of which, between its vertically extending arms, is sufficiently large to accommodate the glass panel or pane 252 and also the entire width of the vertical or side frame members. As shown in FIG. 7, the vertical frame members are designated by reference numerals 214 and 224 for the door 210, and by reference numerals 232 and 238 for the door 230. It will be noted that the top, horizontally extending frame members 216 and 236 are substantially identical in general configuration.

The glass panel 252 is shown terminating below the bottom of the inverted, U shaped channel of the frame member 236, and also below the top of the vertically extending frame members, of which the frame member 238 is shown in FIGS. 8 and 10. Above the glass panel 252 is a metal strap 256. The strap occupies most of the space between the top edge of the glass panel 252 and the horizontal portion of the frame member or element 236. A gap is left above the strap for expansion purposes, as discussed below. While the bottom, horizontally extending frame members and the vertical side frame members may be secured together, as by welding, or the like, the top horizontal frame members for both doors is secured to the vertical frame members and to the strap 254, by screws 256. As shown in FIG. 8, the screw 256 extends through one arm, the inner arm or inner vertically extending portion, of the top frame 236, and through the upper portion of the vertical frame member 238. Since the screw 256 is inserted from the rear, it is not seen when the doors are in their closed position.

In FIG. 10, the knob 240 (see also FIG. 7) is shown secured to the front vertically extending arm or element of the top frame member 236 by means of a screw 258. The screw 258 is inserted into the frame member 236 from the rear, as is the screw 256, as shown in FIG. 8. However, the screw 258 extends through both vertically extending arms of the frame member 236, and through the strap 254, above the glass pane or plate 252. The knob 254 threadedly engages one end of the screw 258 to secure the knob 240 to the horizontal frame member 236 and to the strap 254.

It will be noted that the screw 256 extends into a portion of the vertical frame member 238, and accordingly the vertical frame member 238 and the frame member 236 are secured together only at the corners. With respect to the knob 240, the knob, as shown in FIG. 7, is displaced slightly from the juncture of the vertical frame member 234 and the horizontal frame member 236, and thus the screw 258 does not extend through the vertical frame member. If desired, of course, the knob 242 may be located or positioned at the juncture of the vertical and horizontal frame members, in their overlapping portion. Similarly, the knob 220, also shown in FIG. 7, is appropriately secured to the horizontal frame member 216, and it may be secured to both the horizontal frame member 216 and the vertical frame member 214, in their overlapping juncture area, if desired. A vertically extending plate 242 is secured along the side frame member 234 and along the entire height (or length) of the frame 230. The plate extends outwardly behind the corresponding frame member 214 of door frame 210. The plate acts as a seal for the space between the doors. It also cooperates to hold door 230 closed when latch 222 is secured to the latch 298. The latch 222 is preferably of the male type, while the latch 298 is of the female type which receives the latch 222.

The frame member 238 includes a piano type hinge 244, which extends substantially the full length of the frame member or element 238. The hinge 244 includes a plate 246, which, like the plate 226, has three slots 248 extending inwardly from an outer edge of the plate.

The door frame 210 receives the glass pane or panel 250, and the door frame 230 receives the glass panel or pane 252.

As best shown in FIGS. 8, 9, and 10, the glass panes or panels are not cut to the same dimensions as are the door frames, but rather there is sufficient difference in the dimensions to allow for the expansion and contraction of the metal door frames and of the glass panels or panes. In FIGS. 8, 9, and 10, there is shown a space between the top of the glass panel 252 and the frame member or element 236 to allow for such expansion and contraction.

A door side facing 260 is shown spaced apart from the door frame 210. The side facing 260 includes a front panel 262 and an edge panel or strip 264 extending substantially perpendicular to the front panel 262. The width of the edge panel or strip 264 is relatively short, as compared with the width of the panel 262. The edge panel or strip 264 extends substantially the full length of the panel 262. Extending substantially perpendicular to the panel 262, and parallel to the strip 264, and from the opposite sdge of the panel 262 from the strip 264, is a side panel 266. The side panel 266 does not extend the full length of the panel 262, but is somewhat less in length than the side panel 262 and is appropriately centered with respect to the length of the front panel 262. The panel 266 includes three apertures 268. The apertures or holes 268 are spaced apart equal distance from each other and cooperate with the slots 228 of the hinge plate or panel 226 of the door frame 210. The mating slots and holes or apertures receive bolts or screws, such as shown in FIGS. 8, 9, and 10, to fasten the various frame members to either a masonry or a metal fireplace.

On the opposite side of the door panel 230, there is a side facing 270, which is substantially identical to the facing 260. The facing 270 includes a front panel 272, an edge panel or strip 274, and a side panel 276 secured to the front panel 272 remote from the edge strip 274. As with respect to the edge strips 264, the edge strip 274 extends substantially perpendicular to the front panel 272. The side panel 276 includes three holes or apertures 278 which extend through the panel 276, and cooperate with the slots 248 of the plate 276, as shown in FIG. 9. The slots 228 and 248 permit the adjustment or movement of the doors relative to the side facings.

An upper facing 280 extends the full width of the door apparatus, and it includes a front panel 282, an upper edge strip 284, which extends substantially perpendicular to the front panel 282, and a side panel 286. The side panel 286 extends in length somewhat less than the full length of the front panel 282, and it includes three apertures 288 extending through the panel 286. The upper facing 280 is substantially of the same general configuration as are the side facings.

The upper facing 280 cooperates with an upper door jamb 290 for sealing the front of the door apparatus to the fireplace in which the fireplace apparatus 10 is inserted and with which the door apparatus 200 is used.

The upper door jamb 290 includes a primary panel 292, which is disposed against, and parallel with, the side panel 286 of the upper facing, as best shown in FIG. 10. The primary panel includes three slots 294, which cooperate with the apertures or holes 288 in the side panel 286. At the front portion of the primary panel 292, remote from the slots 294, is a generally vee shaped sealing face 296. The sealing face is flexible and serves to seal against the upper door frames, such as the frame members 236, shown in FIGS. 8, 9, and 10. The sealing face is secured to the primary panel 292. This is best shown in FIGS. 8 and 10. The slots 294 allow the door jamb 290 to be moved relative to the facing 280.

For the bottom of the doors, a lower facing 300 and a lower door jamb 310 is used. The construction of the lower facing 300 and of the lower door jamb 310 is substantially as described above, with respect to the upper facing 280 and the upper door jamb 290.

The lower facing includes a front panel 302, an edge strip 304, and a side panel 306. Apertures or holes 308 extend through the side panel and mate with the slots 314 which extend through a primary panel 312 of the lower door jamb 310. A vee shaped sealing face 316 extends from the front edge of the primary panel 312, remote from the slots 314. The bottom door frame elements abut the sealing face 316 to seal the lower parts of the doors, as described above in conjunction with the sealing face 296, and as shown in FIGS. 9, 10, and 11.

The door apparatus 200 is shown in FIG. 8 as secured to the apparatus 10, while in FIGS. 9 and 10 the door apparatus 200 is shown secured to an existing masonry fireplace. In FIG. 8, a screw 320 is shown securing the side panel 286 of the upper facing 280 and the door jamb 290 to the inner top wall 62. Above the wall 62 is part of a screen 322. The screen 322 is simply a decorative element which covers the front of the apparatus 10 except for the doors 210 and 230 which open into the firebox 58 (see FIGS. 1 and 2). The front panel 282 of the facing 280 extends upwardly a short distance along the screen 322. The four facings (see FIG. 7) do not cover a substantial area of the screen 322 on the front of the apparatus 10 and accordingly do not significantly affect the airflow of the heated air into and out of the apparatus.

In FIGS. 9 and 10, the door apparatus 200 is shown secured to an existing masonry fireplace 330. The side facing 270 and the plate 246 of the door 230 are secured to an inside wall 332 by a plurality of bolts or screws 324. The top or upper facing 280 and the upper door jamb 290 are secured to a top wall 334 of the fireplace 330 also by a plurality of bolts or screws 324. The fasteners 324 extend through the aligned hole or apertures and slots in the respective panels to secure the door apparatus 200 in place, as discussed above. A masonry anchor 326 may be required.

The door apparatus 200, as discussed above, may be used either to seal the firebox 58 of the fireplace apparatus or it may be used to enclose the front of an existing masonry fireplace.

The air flow for the combustion air in the apparatus 10 is such that the glass doors 250 and 252 are not smudged and covered with soot from smoke. The air flow is directed vertically upwardly through the grates, past the fuel, and on upwardly to the chimney (not shown). This movement of the air provides oxygen for substantially complete combustion which decreases the production of soot from incomplete combustion. Moreover, the forward and upward movement of the combustion air also reduces substantially the swirling air currents which, in prior art fireplaces, deposit soot from the smoke on fireplace doors. The swirling movement generally results from the rearward and upward flow of air in a combustion chamber. The flow then moves forwardly and then downwardly, past the glass doors and deposits soot on the doors. The swirling air flow continues. However, with the initial forward and upward movement of the air, as through the air valve 130 and the grates 110, no swirling pattern is established. At the same time, the vertical air flow by the fuel on the grates provides sufficient oxygen for substantially complete combustion. With horizontal air flow of prior art fireplaces, the actual oxygen delivered to the fuel is less than required for substantially complete combustion, and soot is accordingly produced.

When the air flow through the air valve 130 is decreased, by movement of the handle 164 and the cable 160 to pivot the valve plate 154, the air flow pattern is still upwardly and forwardly, as discussed above. However, the flow or volume of the air is reduced by the positioning (closing) of the valve plate. Accordingly, the amount of combustion is reduced, but the combustion taking place is still substantially complete. The air flow pattern, vertically over the faces of the fuel, promotes or allows substantially complete combustion. The rate of combustion is thus controlled by controlling the flow of air through the air valve.

The apparatus of the present invention comprises a fireplace apparatus which acts as a furnace in the combusting of fuel, and which may be inserted into a preexisting, masonry fireplace. The apparatus substantially increases the heating efficiency of fuel burned within the apparatus, when compared with prior art fireplaces.

The apparatus uses a dual air supply, with the combustion air received from an exterior source, and the heated air derived from the inside of the building or structure in which the apparatus is located. The two air supplies are thus separate and distinct without any intermixing.

The front of the apparatus is closed by a pair of hinged doors which prevents the room or heated air from mixing with the combustion air in the combustion chamber. With the doors, there is a separation of the two air flows and the combustion air, which flows beneath the apparatus vertically through the grates, is not subject to any side drafts, or the like, which would change the general direction of the flow of the combustion air.

It will be noted that the door apparatus of the present invention may be utilized with conventional fireplaces by securing the doors to the preexisting fireplaces. However, in such cases, a source of combustion air must be provided.

While the principles of the invention have been made clear in illustrative embodiments, there will be immediately obvious to those skilled in the art many modifications of structure, arrangement, proportions, the elements, materials, and other components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Prefabricated fireplace apparatus insertable into a preexisting masonry fireplace in a building for heating air in a room, comprising, in combination:

a combustion chamber;

a first heated air chamber means disposed adjacent the combustion chamber for receiving a first flow of air from the room to be heated;

second air chamber means disposed adjacent the combustion chamber for receiving a second flow of air from the room to be heated;

manifold means for receiving a third flow of air from the room to be heated;

third air chamber means disposed adjacent the combustion chamber for receiving the third flow of air from the room to be heated, and disposed between and communicating with the first and second air chamber means;

fourth air chamber means disposed above the combustion chamber for receiving a flow of heated air from the third air chamber;

duct means extending between the third and fourth air chambers through which the heated air flows from the third air chamber means to the fourth air chamber means;

grate means extending between the manifold means and the third air chamber means through which the third flow of air flows from the manifold means to the third air chamber means;

means for providing a flow of outside air to the combustion chamber;

air valve means for controlling the flow of outside air to the combustion chamber; and door means for separating the first, second, and third flows of air in and from the room to be heated from the combustion air in the combustion chamber.

2. The apparatus of claim 1 in which the duct means comprises a plurality of ducts spaced apart from each other and disposed over the combustion chamber.

3. The apparatus of claim 2 in which the grate means comprises a plurality of hollow grates disposed beneath the combustion chamber and spaced apart to allow the outside air to flow from the air valve means to the combustion chamber between the spaced apart grates.

4. The apparatus of claim 3 in which the manifold means extends between the first air chamber means and the second air chamber means and includes a top panel, a front panel, and a rear panel, and the front and rear panels are connected to the top panel.

5. The apparatus of claim 4 in which the first air chamber means includes a first horizontally extending baffle and a first vertically extending panel secured together for controlling the first flow of air into and out of the first air chamber means.

6. The apparatus of claim 5 in which the second air chamber means includes a second horizontally extending baffle and a second vertically extending panel secured together for controlling the second flow of air into and out of the second air chamber means.

7. The apparatus of claim 1 in which the door means includes frame means for supporting a panel of glass;

hinge means secured to the frame means;

panel means secured to the hinge means remote from the frame means for pivotally securing the frame means to the combustion chamber;

side facing means secured to the panel means for providing a seal between the frame means and the combustion chamber;

door jamb means for providing a further seal between the frame means and the combustion chamber, and including an upper door jamb, and a lower door jamb;

an upper facing for sealing the upper door jamb and the combustion chamber; and a lower facing for sealing the lower door jamb and the combustion chamber.

8. The apparatus of claim 7 in which the frame means includes a first door frame and a second door frame pivotally secured to the combustion chamber.

9. The apparatus of claim 8 in which the hinge means and the panel means include a first and a second hinge secured respectively to the first and second door frames, and a first and second panel secured respectively to the first and second hinges for securing the first and second door frames to the combustion chamber.

10. The apparatus of claim 9 in which the first and second door frames are pivotally secured to the combustion chamber adjacent the first and second air chambers, respectively.

11. The apparatus of claim 1 in which the grate means includes a plurality of hollow grates and tray means disposed beneath the plurality of hollow grates for receiving ashes from combustion within the combustion chamber means.

12. The apparatus of claim 11 in which the tray means is spaced apart from the plurality of hollow grates to allow the air from the air valve means to flow above the tray means and between the spaced apart hollow grates.

13. The apparatus of claim 12 in which the tray means includes a front panel which is disposed against the rear panel of the manifold means for sealing the third flow of air from the flow of air through the air valve means to the combustion chamber.

14. Door apparatus for the combustion chamber of a fireplace, comprising, in combination:

frame means;

glass means secured to the frame means;

hinge means secured to the frame means and to the fireplace for pivotally securing the frame means to the fireplace;

side facing means secured to the hinge means for providing a seal between the frame means and the combustion chamber;

door jamb means for sealing the frame means adjacent the side facing means, and including an upper door jamb, and a lower door jamb;

an upper facing for sealing the frame means at the upper door jamb and the combustion chamber; and a lower facing for sealing the frame means at the lower door jamb and the combustion chamber.

15. The apparatus of claim 14 in which the frame means includes a first door frame and a second door frame, both pivotally secured to the fireplace, and the glass means includes a first and a second panel of glass secured respectively to the first and second door frames.

16. The apparatus of claim 15 in which the hinge means includes a first and a second hinge secured respectively to the first and second door frames, and a first and a second panel secured respectively to the first and second hinges for securing the first and second door frames to the fireplace.

* * * * *